US007356863B2

(12) United States Patent
Oprandi

(10) Patent No.: US 7,356,863 B2
(45) **Date of Patent: *Apr. 15, 2008**

(54) MATTRESS PAD

(76) Inventor: Arthur V. Oprandi, 385 N. Point Rd. #1001, Osprey, FL (US) 34229

( * ) Notice: Subject to any disclaimer, the term of this patent is extended or adjusted under 35 U.S.C. 154(b) by 171 days.

This patent is subject to a terminal disclaimer.

(21) Appl. No.: 11/282,168

(22) Filed: Nov. 19, 2005

(65) Prior Publication Data

US 2007/0113349 A1 May 24, 2007

(51) Int. Cl.
*A47C 27/14* (2006.01)

(52) U.S. Cl. ..... 5/691; 5/731; 5/500; 5/502; 5/740

(58) Field of Classification Search ..... 5/727, 5/417, 420, 482, 485, 486, 500, 502, 632, 5/691, 731, 737, 738, 740, 655.9, 953
See application file for complete search history.

(56) References Cited

U.S. PATENT DOCUMENTS 3,093,407 A * 6/1963 Wilson ..... 297/4
3,293,671 A * 12/1966 Griffin ..... 5/655.9
3,378,861 A * 4/1968 Lousberg ..... 5/733
3,469,882 A * 9/1969 Larsen ..... 297/118
3,639,927 A * 2/1972 Munch ..... 5/723
3,736,023 A * 5/1973 Lyons ..... 297/118
3,742,528 A * 7/1973 Munch ..... 5/723
3,843,980 A * 10/1974 Rodriguez ..... 5/733
4,128,272 A * 12/1978 Boyle ..... 297/284.3
4,394,783 A * 7/1983 Simmons ..... 297/230.1
4,635,306 A * 1/1987 Willey ..... 5/632
4,665,573 A 5/1987 Fiore
4,688,283 A 8/1987 Jacobson et al.
4,748,703 A * 6/1988 Emi et al. ..... 5/502
4,843,666 A * 7/1989 Elesh et al. ..... 5/723
4,901,384 A * 2/1990 Eary ..... 5/632
4,905,330 A * 3/1990 Jacobs ..... 5/705
4,922,564 A 5/1990 Thomas
4,944,059 A * 7/1990 Wall ..... 5/631
4,972,535 A 11/1990 Goldman
4,987,625 A * 1/1991 Edelson ..... 5/657
4,995,220 A * 2/1991 Thomas ..... 53/418
5,111,542 A 5/1992 Farley
5,117,519 A * 6/1992 Thomas ..... 5/500
5,224,226 A 7/1993 Groenewald
5,252,278 A 10/1993 Spann et al.
5,303,435 A * 4/1994 Haar et al. ..... 5/709
5,388,295 A * 2/1995 Sarkozi ..... 5/630
5,430,901 A 7/1995 Farley (Continued)

*Primary Examiner*—Robert G. Santos
(74) *Attorney, Agent, or Firm*—Charles J. Prescott

(57) ABSTRACT

A mattress pad positionable atop a rectangular mattress which better accommodates diverse weights and sizes of the human anatomy for enhanced comfort. The mattress pad includes a flexible bottom sheet having a size and shape substantially similar to that of a top surface of the mattress. A flexible fabric top sheet is connected to the bottom sheet by peripheral stitching along common perimeter side, head and foot margins. A plurality of generally side-by-side body supporting chambers are each defined by peripheral stitching and spaced lines of continuous stitching which interconnect the top and bottom sheets. Each chamber is filled with an open or closed cell urethane foam material. Preselected nominal thicknesses of each of the chambers provides the comfort and accommodation to each portion of the human anatomy.

22 Claims, 17 Drawing Sheets

U.S. PATENT DOCUMENTS 5,448,790 A * 9/1995 Saro et al. ..... 5/657
5,474,513 A * 12/1995 Carlesimo et al. ..... 482/140
5,504,953 A * 4/1996 Singer-Leyton et al. ..... 5/631
5,509,153 A 4/1996 Roschacher
5,652,981 A * 8/1997 Singer-Leyton et al. ..... 5/631
5,655,241 A 8/1997 Higgins et al.
5,671,492 A 9/1997 Simon
5,742,963 A 4/1998 Trevino et al.
5,815,865 A 10/1998 Washburn et al.
6,003,178 A 12/1999 Montoni
6,038,722 A 3/2000 Giori et al.
D433,861 S 11/2000 Rose et al.
6,154,903 A 12/2000 Wai-Chung
6,202,239 B1 3/2001 Ward et al.
6,233,768 B1 5/2001 Harding
6,442,778 B1 * 9/2002 Shaharbani ..... 5/636
6,568,015 B1 5/2003 Allen
6,823,545 B1 * 11/2004 Davis ..... 5/630
6,957,465 B1 10/2005 Oprandi
7,020,918 B1 * 4/2006 Tinsley ..... 5/632
7,100,229 B2 * 9/2006 O'Reagan ..... 5/736
2005/0044635 A1 * 3/2005 O'Reagan ..... 5/736
2005/0076448 A1 * 4/2005 O'Reagan ..... 5/736
2007/0101505 A1 * 5/2007 Oprandi ..... 5/710
2007/0113349 A1 * 5/2007 Oprandi ..... 5/691

* cited by examiner 46h
12
10
14
16
A
46s
26
B
18
30
8
C
28
20
32
46s
7
D
22
34
E
46
46f
24

MATTRESS PAD

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to therapeutic body support pads and more particularly to an anatomically conformable mattress pad or overlay positionable atop a conventional mattress for enhanced body comfort for a recumbent person.

2. Description of Related Art

Conventional mattresses are typically designed for the general public or typical users to provide a reasonable degree of comfort to a broad base range of people. Although it is well known that the comfort level is heightened to the extent that the mattress conforms to the individual curves of the human anatomy, nonetheless it is commercially impractical to accommodate this need for the mass media.

A number of prior art inventions have attempted, some perhaps successfully, to either provide an entirely new mattress or to provide a mattress pad fitted atop a conventional mattress which better accommodates the individual anatomical needs for those who wish to have a more individualized custom fitting body support in the recumbent position thereatop.

In U.S. Pat. No. 5,430,901, Farley teaches an anatomically comfortable therapeutic mattress overlay which is intended to redistribute body weight away from prominent areas of the human body and also to support selected anatomical body portions. This overlay includes a substantially planar resilient member including selected reinforcements between side edges which facilitate rotating a patient while in the recumbent position. This pad also includes cutouts to define handle holds by which to grasp the resilient pad.

In U.S. Pat. No. 4,922,564, Thomas teaches a therapeutic mattress having a resilient bottom mattress section and a top mattress section comprised of a plurality of interconnected top mattress sections. A plurality of parallel rows of stitching interconnect the top and bottom covers, intermediate stitching also interconnecting the top and bottom to define the parallel rows of rectangular tubes which are filled with a compacted fibrous resilient material.

Jacobson, in U.S. Pat. No. 4,688,283, teaches a mattress which conforms to a body profile by having flexible air-tight chambers which are interconnected to allow the transfer of air or fluid between two such chambers to facilitate body contour accommodation. The volume of air or fluid may be adjusted in each of the individual and interconnected chambers to allow comfortable resistance and conformity to a wide range of body lengths, weights and shapes.

The following additional U.S. patents are of known prior art and are somewhat more remotely connected to the present invention:

U.S. Pat. No. 4,665,573 to Fiore
U.S. Pat. No. 5,224,226 to Groenewald
U.S. Pat. No. 5,509,153 to Roschacher
U.S. Pat. No. 5,742,963 to Trevino, et al.
U.S. Pat. No. 4,972,535 to Goldman
U.S. Pat. No. 5,671,492 to Simon
U.S. Pat. No. 5,111,542 to Farley
U.S. Pat. No. 6,568,015 to Allen
U.S. Pat. No. 6,038,722 to Giori, et al.
U.S. Pat. No. 5,815,865 to Washburn, et al.
U.S. Pat. No. 6,154,903 to Wai-Chung
U.S. Pat. No. 5,720,061 to Giori, et al.
U.S. Pat. No. 6,003,178 to Montoni
U.S. Pat. No. 6,202,239 to Ward, et al.
U.S. Pat. No. 5,655,241 to Higgins, et al.
U.S. Pat. No. 6,233,768 to Harding
U.S. Pat. No. 5,252,278 to Spann, et al.
U.S. Patent Des. 433861 to Rose, et al.

In my U.S. Patent, I describe a mattress or pad similar to that of the present invention, but having loose fibrous material in each of the chambers which may be easily moved about for tailored support.

The present invention provides a mattress pad positionable atop a conventional mattress which includes individualized chambers defined by interstitching between top and bottom covers and which are filled with closed or open cell foam or foam-like material, and preferably, viscoelastic slab stock foam, a/k/a slow recovery or memory foam material sized to fit within each of the chambers supporting the head, upper torso, legs and feet into better conformity with the individualized contours of each recumbent user of this invention.

BRIEF SUMMARY OF THE INVENTION

This invention is directed to a mattress pad positionable atop a rectangular mattress for accommodation of the diverse weight and sizes of the human anatomy for enhanced comfort. The mattress pad in one embodiment includes a flexible bottom sheet having a size and shape substantially similar to that of a top surface of the mattress. A flexible fabric top sheet is preferably connected to the bottom sheet by peripheral stitching along common perimeter side, head and foot margins. A plurality of generally side-by-side body supporting members are each defined by peripheral stitching and spaced lines of continuous stitching which interconnect said top and bottom sheets. Each body supporting member is filled with a resilient, compressible, substantially homogeneous or uniform closed or open cell urethane or polyurethane foam, preferably a viscoelastic polyurethane foam having slow recovery characteristics, a/k/a memory foam. In another embodiment, the mattress top pad is mold formed as a unit of viscoelastic polyurethane such as a memory foam molded in one piece. Preselected thicknesses of each of the body support members provide the comfort and accommodation to each of the portions of the human anatomy.

It is therefore an object of this invention to provide a mattress pad which is positionable atop a conventional mattress which will greatly enhance the comfort and accommodation to individualized body sizes, shapes and weights of each person on an individual basis.

Still another object of this invention is to provide a mattress pad having chambers filled with viscoelastic slow recovery memory foam to enhance the comfort level of a person lying recumbent thereupon.

Yet another object of this invention is to provide a mattress pad positionable atop a rectangular mattress which will accommodate two persons lying side-by-side thereatop.

Another object of this invention is to satisfy the above objects in the form of an originally manufactured mattress.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 5:
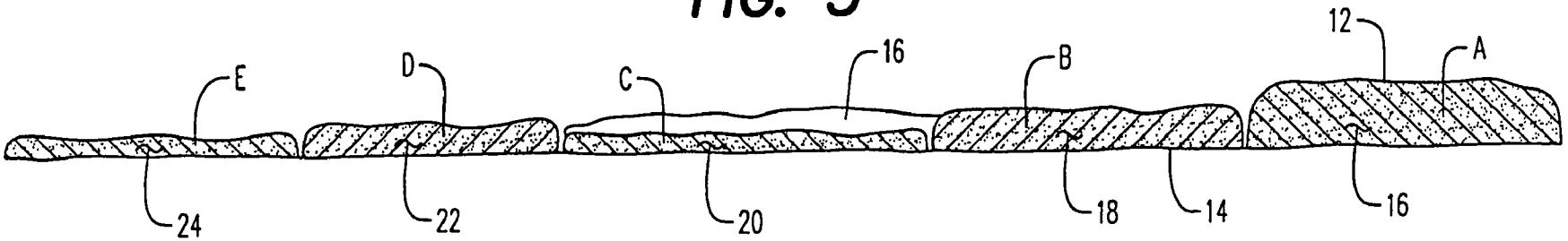
FIG. 5 is a section view in the direction of arrows 5-5 in FIG. 1.
Figure 6:
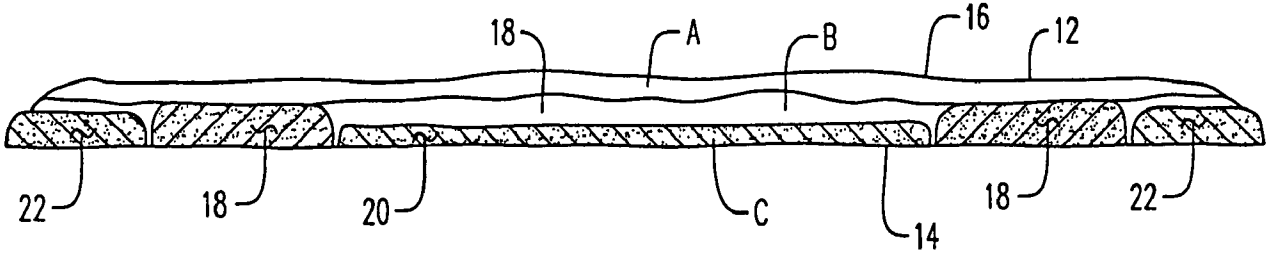
FIG. 6 is a section view in the direction of arrows 6-6 in FIG. 1.
Figure 7:
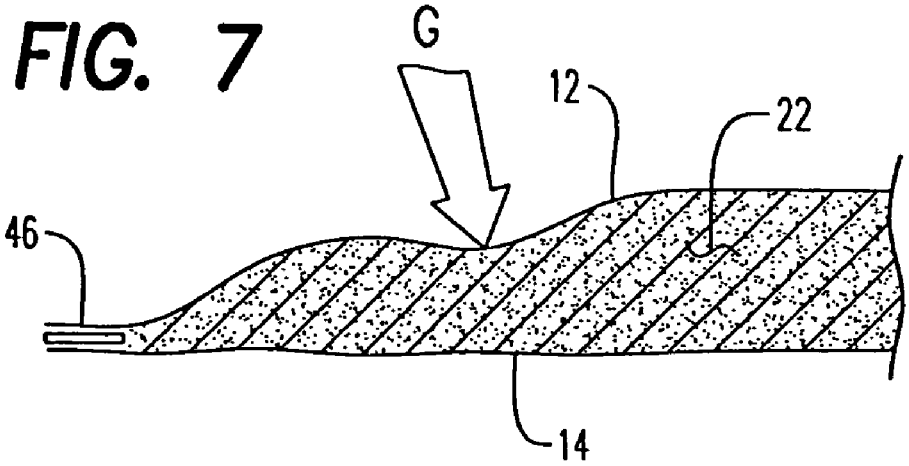
FIG. 7 is an enlarged section view of area 7 of FIG. 2.

Referring now to the drawings, and firstly to FIGS. 1 and 3 to 8, one embodiment of the invention is there shown generally at numeral 10 and includes a flexible, substantially rectangular fabric top sheet 12 and a flexible bottom sheet 14 which are stitched together along common head, foot and side margins shown generally at numeral 46 and as detailed in FIG. 7. Material selection in forming the top and bottom sheets includes flexible sheet cotton, wool, linen, plastic, latex and all other organic or synthetic flexible sheet materials. Within the rectangular perimeter borders 46 of this mattress pad 10 are formed a plurality of spaced lines of continuous intermediate stitching referred to generally at 26, 28, 30, 32 and 34. In this embodiment 10, these stitching lines are straight for manufacturing convenience.

Intermediate stitch line 26 has a generally transverse central component and downwardly descending diagonal components which define a first chamber 16 between the head peripheral margin 46*h* and intermediate stitching line 26. A second chamber 18 is defined between the first stitching line 26 and the second stitching line segments 28 and 30. Chamber 18 is positioned to support the upper torso of a person recumbent upon the mattress pad 10 having diagonally extending portions to also support the arms in a partially extended position as shown. Chamber 20 is formed centrally of the mattress pad 10 to support the lower torso between stitching lines 30 and 32. The central legs are supported on chamber 22 which is formed between stitching lines 28, 32, and 34 while the foot support chamber 24 is formed between the stitching lines 34 and the foot peripheral margin 46*f*.

Figure 2:
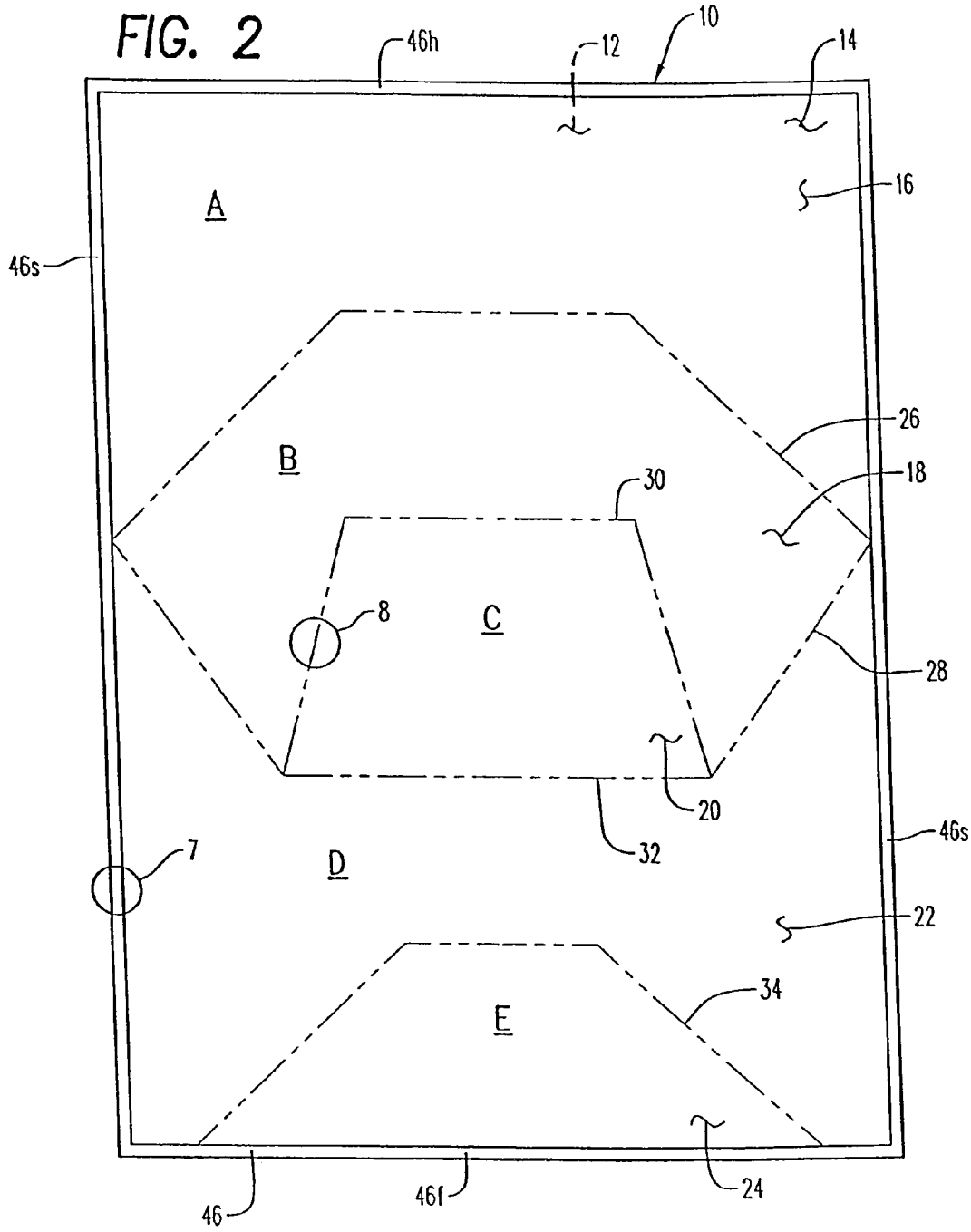
FIG. 2 is a top plan simplified schematic view of another embodiment of the invention similar to that of FIG. 1.

As best seen in FIGS. 3 to 8, each of the support chambers 16, 18, 20, 22 and 24 are formed of a core slab or substantially continuous preferably one-piece sheet of a compressible open or closed cell foam which may include polyester foam, memory foam, viscoelastic foam, and mixtures thereof and in different chambers. However, the preferred foam is that of an open-cell polyurethane viscoelastic slow recovery memory foam. The top sheet 12 in FIG. 2 is sized to accommodate the selected amounts of foam material thickness as described herebelow.

In chamber 16, which supports the head and neck area of a person recumbent upon the mattress pad 10, a greater height A of foam material is preferred to fill this first chamber 16. The second chamber 18 is filled with a slightly less thick foam material at B while the third chamber 20 is filled with a still less height of the chosen foam material at C. The leg support chamber 22 is filled with a slightly greater thickness of foam material at D while the foot support chamber 24 is filled with a lesser thickness of the synthetic foam material at E.

Figure 3:
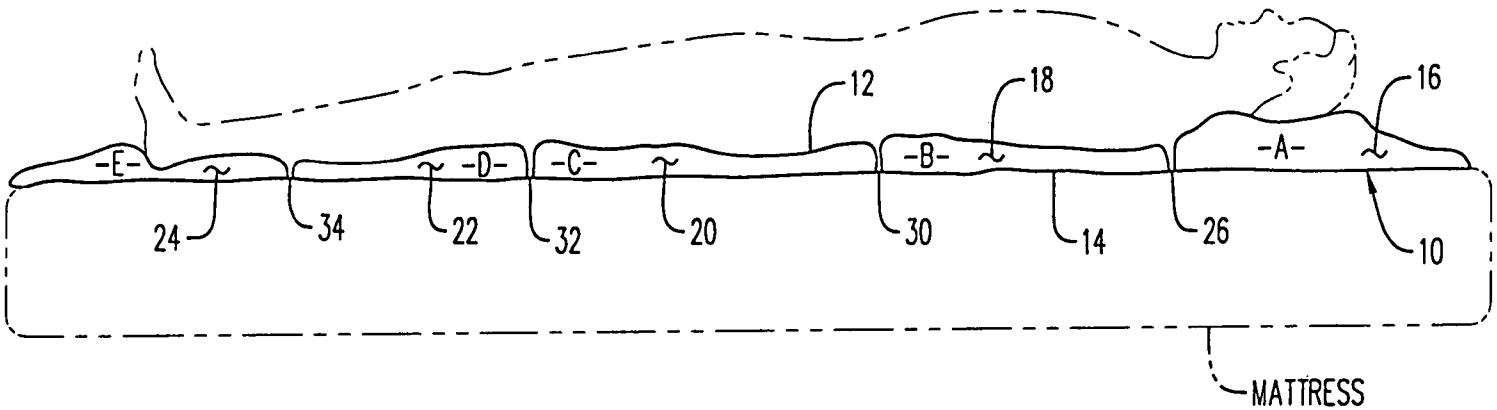
FIG. 3 is a side elevation simplified schematic view of the invention of FIG. 1 positioned atop a polyurethane mattress showing a recumbent person lying face up thereatop.
Figure 4:
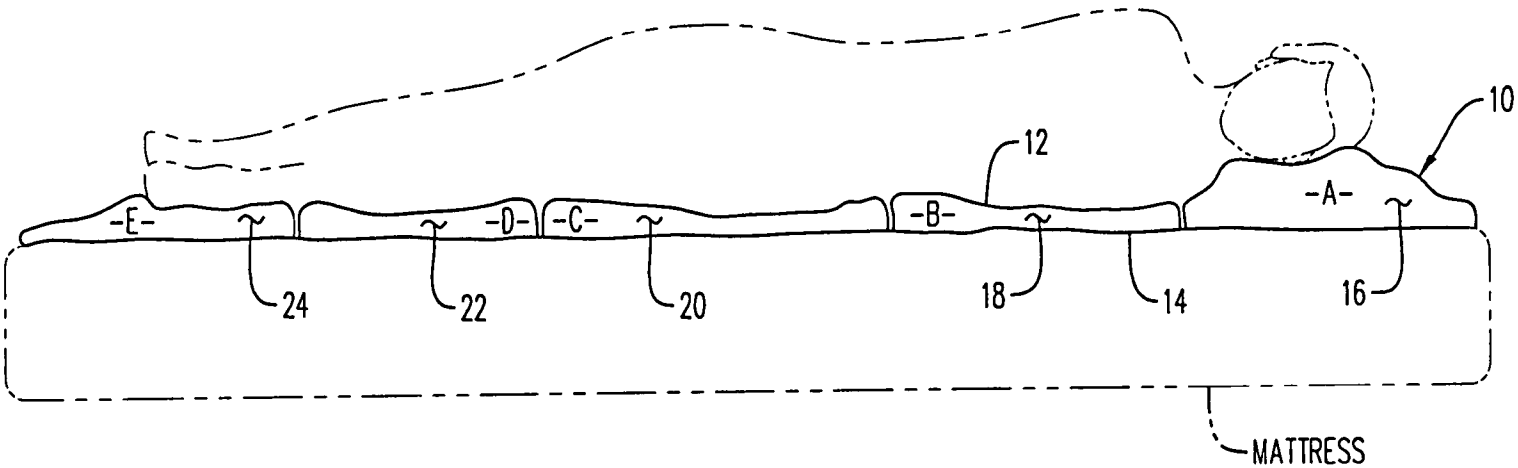
FIG. 4 is a view similar to FIG. 3 showing the person lying on his or her side.

Seen in FIGS. 3 and 4, showing the mattress pad 10 deployed atop a conventional, preferably polyurethane foam mattress, the recumbent person in a face up position will receive very natural body positioning and alignment, receiving a proper support from each of the chambers 16, 18, 20, 22 and 24. Alternately, when recumbent on the side of the person, each of these chambers 16, 18, 20, 22 and 24 will be transformed simply by body weight as seen typically in FIG. 7, by applying body weight in the direction of arrow G, so as to provide a virtually totally uniform support of each of the body and torso portions for maximum comfort.

Referring to FIGS. 5 and 6, it is noted that the height selections, A, B, C, D and E of each of the chambers 16, 18, 20, 22 and 24, respectively, in combination with the configuration of each of these chambers as defined by the intermediate lines of stitching through the top and bottom sheets previously described create a very compliant series of support chambers both longitudinally as shown in FIG. 5 and laterally as shown in FIG. 6 again to achieve an optimal comfort and body support for the recumbent person lying thereupon.

Figure 5A:
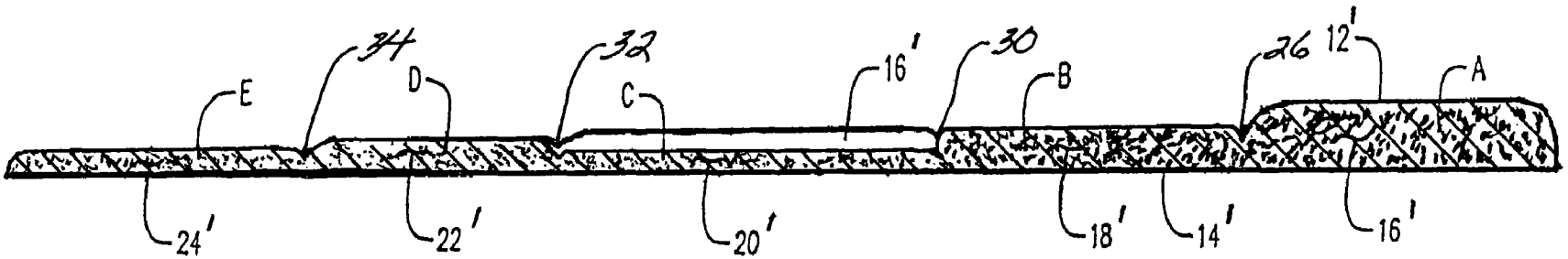
FIG. 5A is a section view similar to FIG. 5 of a one-piece molded embodiment.
Figure 6A:
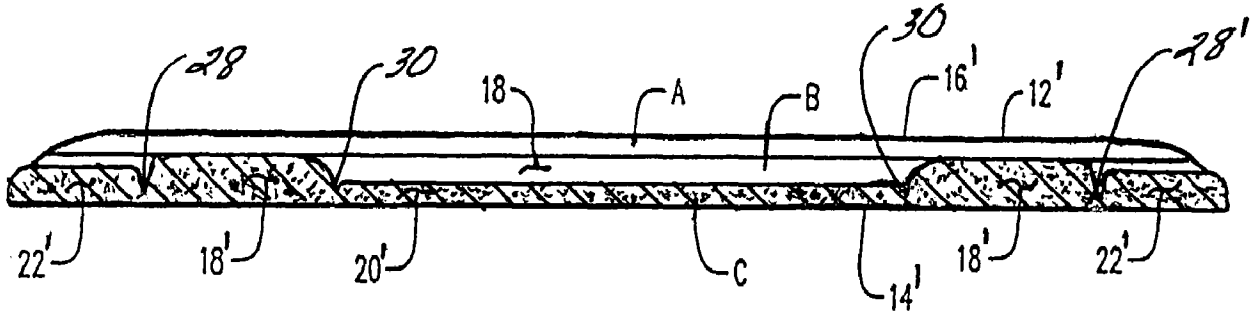
FIG. 6A is a section view similar to FIG. 6 of the one-piece embodiment of FIG. 5A.

Referring now to FIGS. 5A and 6A, an alternate embodiment of the mattress pad is there shown generally at numeral 12' and is formed as a single unit of preferably viscoelastic polyurethane foam material, preferably memory foam. By mold forming the entire mattress pad 12' as a single unit, the need in marketing to include a fabric top sheet or a fabric bottom sheet may be eliminated so that the marketed product itself 12' will be, again, a single molded unit ready to be covered with conventional fabric bed sheeting.

In this embodiment 12', the spaced lines 26, 28, 30, 32 and 34 are indents mold formed into the mattress pad 12 itself rather than being formed of stitching passing through the now deleted top and bottom fabric sheet. Likewise, the heights, A, B, C, D, and E of each of the molded mattress sections 14', 16', 18', 20', 22', and 24' are identical to those described with respect to FIGS. 1 to 5.

Figure 9:
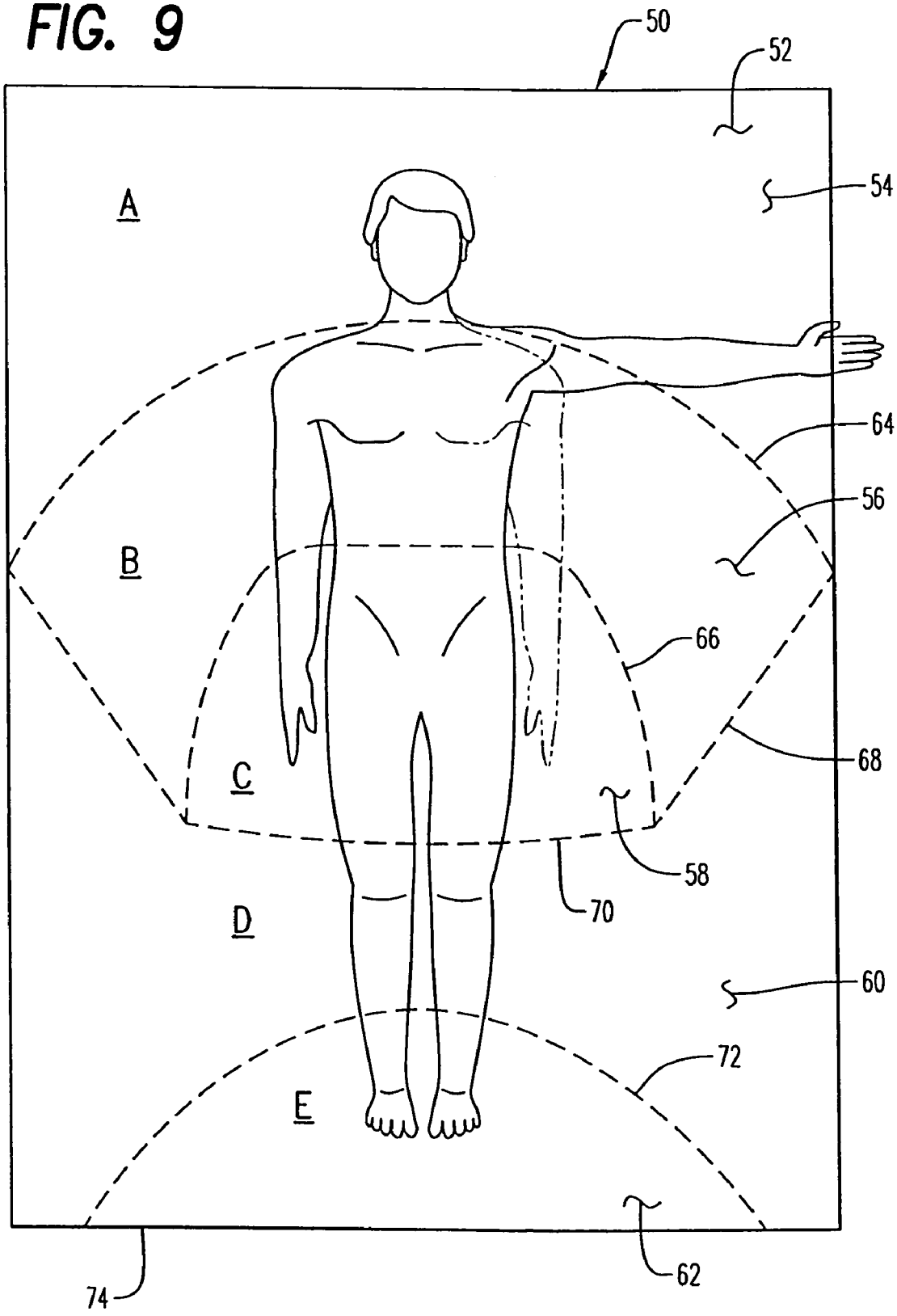
FIG. 9 is a top plan schematic view of another embodiment of the invention.

Referring now to FIG. 9, this alternate embodiment 50 includes a flexible fabric top sheet 52 of flexible fabric material substantially similar to that described with respect to the mattress pad 10. The chambers 54, 56, 58 and 60 which are formed by intermediate lines of stitching, 64, 66, 68, 70 and 72, along with the perimeter margin 74 which is formed by the stitched together periphery between the top sheet 62 and the flexible bottom sheet (not shown). Likewise, the substantially same thicknesses, A, B, C, D and E of each of the chambers 54, 56, 58 and 60 and 62 are provided. By forming the intermediate lines of stitching 64, 66, 70 and 72 in an arcuate configuration rather than as straight lines in the embodiment 10 for maximum comfort in the recumbent position.

Figure 10:
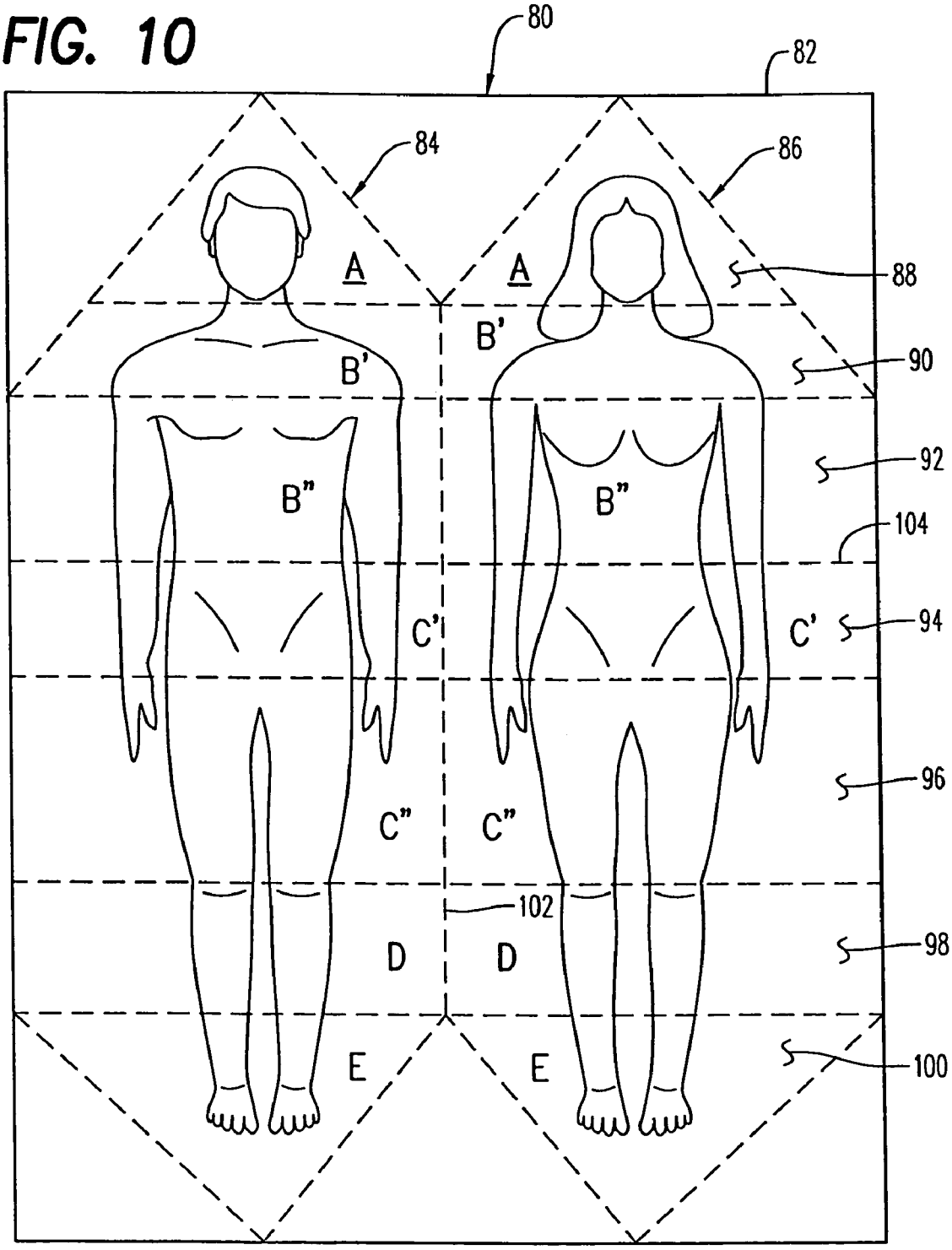
FIG. 10 is a top plan simplified schematic view of still another embodiment of the invention structured to individually accommodate two side-by-side recumbent persons.
Figure 11:
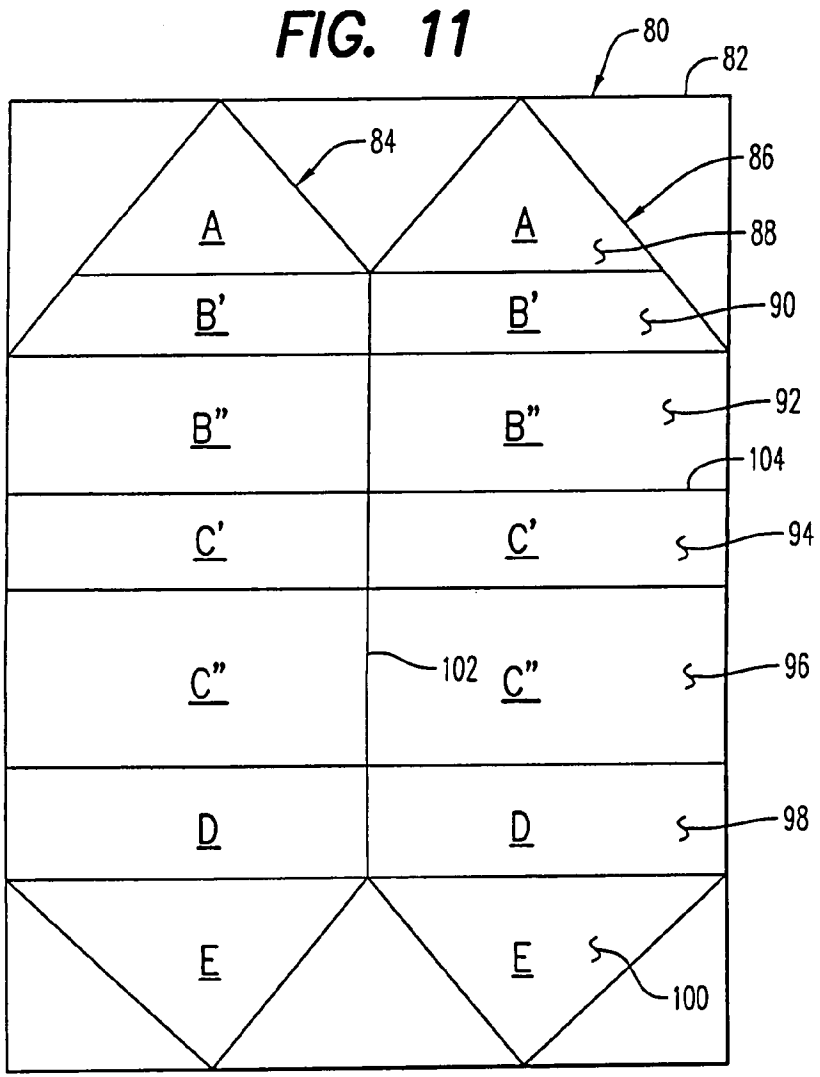
FIG. 11 is a top plan view of FIG. 10 absent the recumbent persons previously shown in phantom.

Referring now to FIGS. 10 and 11, a queen or king-size embodiment is there shown generally at numeral 80 to accommodate two recumbent persons in side-by-side fashion in a conventional double bed arrangement. In this embodiment 80, two separate chamber supported areas 84 and 86 are provided as defined by a longitudinally extending stitch line 102 which is positioned centrally between the periphery side margins of the mattress pad 80.

Again, in this embodiment 80, a head chamber 88, a shoulder chamber 90, a mid-torso chamber 92, a lower torso chamber 94, an upper leg chamber 96, a lower leg chamber 98, and a foot chamber 100 are provided by parallel transverse intermediate stitching lines shown typically at 104.

Figure 1:
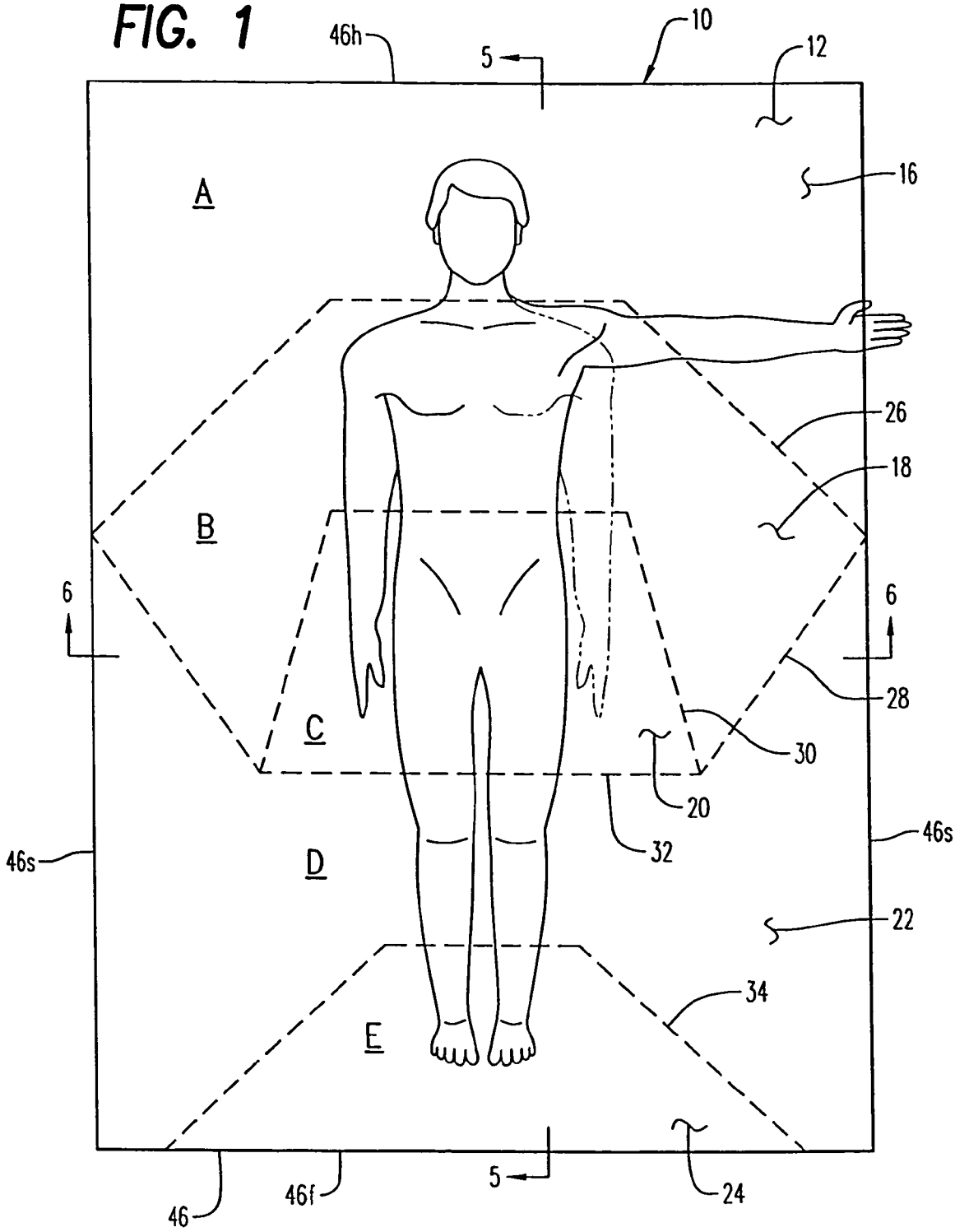
FIG. 1 is a top plan simplified schematic view of one embodiment of the invention.

The height of the foam material filling each of these chambers, 88, 90, 92, 94, 96, 98, and 100 is the same as referenced in FIG. 1 wherein height A is the thickest of the foam material to support the head and neck. Chambers 90 and 92 are separated by a line of transverse stitching to support the upper torso having foam material thickness B' and B" which are generally similar or identical to the foam thickness B in FIG. 1; however, the intermediate stitching line between chambers 90 and 92 serves to provide the same upper torso support in combination as that of foam material thickness B in FIG. 1. Likewise, foam thicknesses C' and C" are substantially equal to one another and to foam thickness C in FIG. 1 but separated by another transverse intermediate line of stitching for preventing excess migration of the foam material within these two chambers 94 and 96.

Figure 12:
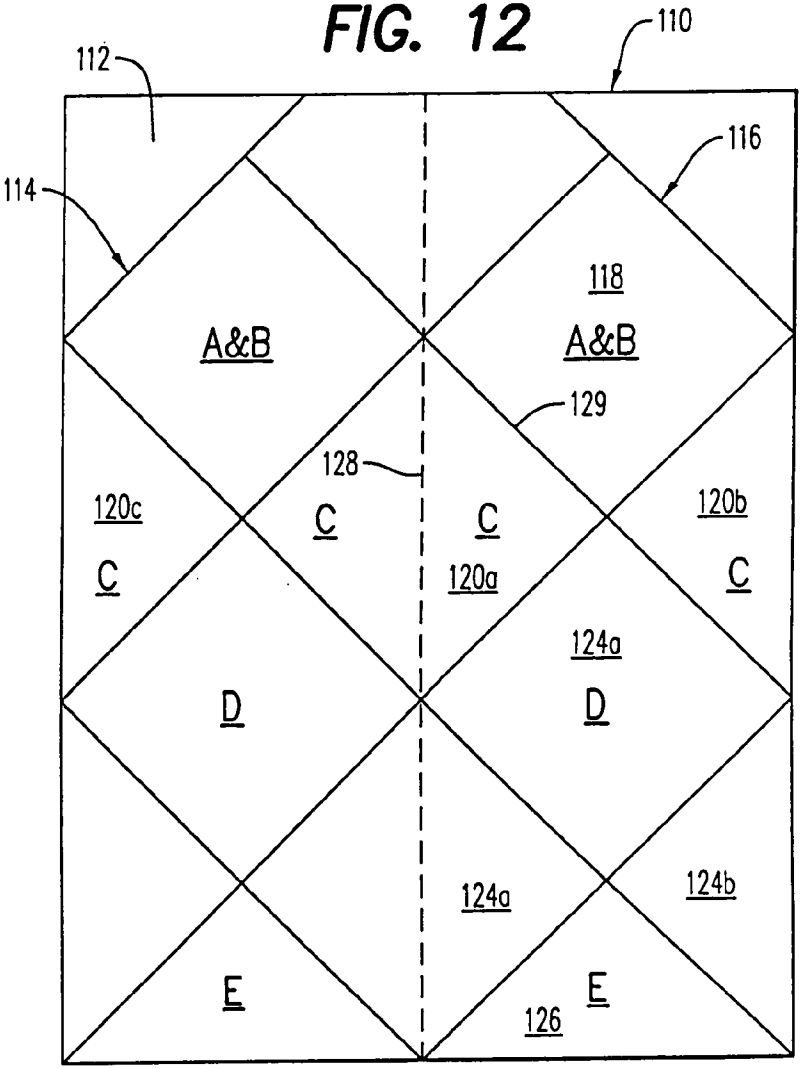
FIG. 12 is a top plan view of yet another embodiment of the invention for use by two recumbent persons.

Referring now to FIG. 12, another two person embodiment of the invention is there shown generally at numeral 110, again as with all embodiments, having a rectangular length and width substantially similar to that of a mattress atop which this embodiment 110 will be disposed for supporting a recumbent person. Two separate body support areas 114 and 116 are provided, separated or defined by a central longitudinal stitching line 128. Each of the diamond shaped chambers 118, 120*a*, 120*b*, 122, 124*a*, 124*b* and 126 are formed by diagonal intermediate lines of stitching shown typically at 129. Note that each half of chamber 120*a*, in combination with chamber 120*b* form the support for the lower torso which would generally be equivalent to chamber 20 in FIG. 1 having a foam height of C. Note further that the head and upper torso are supported by chambers 118 having a foam height equivalent to an average of A and B as previously described.

Figure 13:
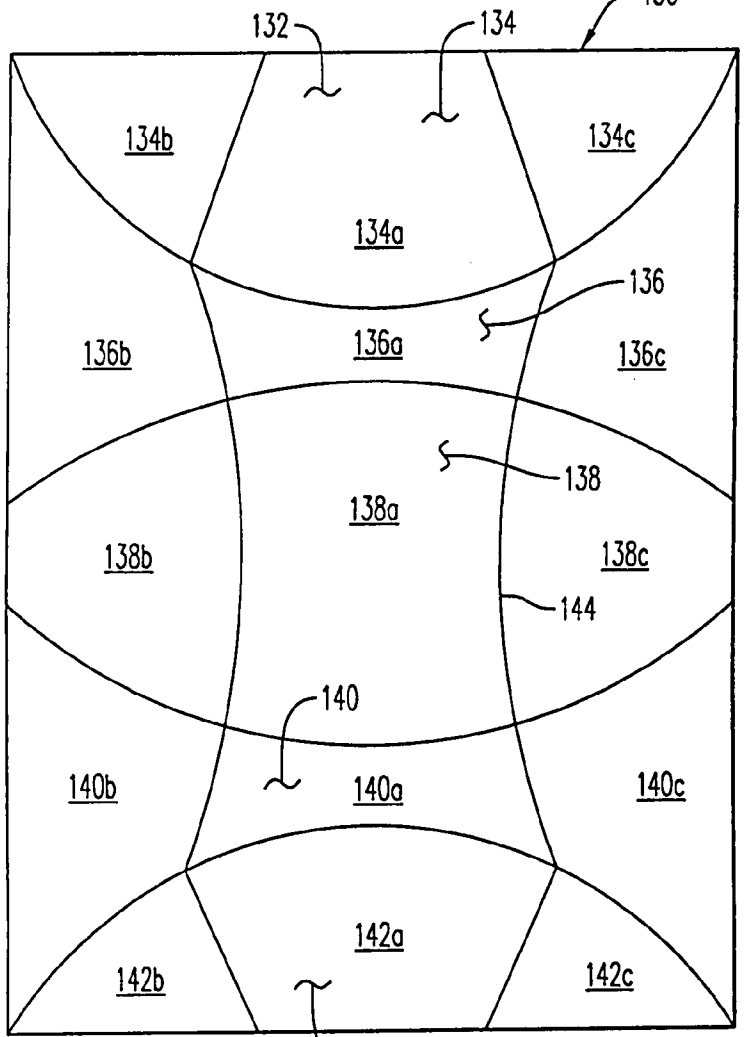

The embodiment 130 shown in FIG. 13 includes a flexible fabric top sheet 132 having intermediate stitching shown typically at 144 passing through both the top sheet 132 and the bottom sheet (not shown) as previously described. This embodiment 130 includes a head support chamber 134 having components 134*a*, 134*b* and 134*c*, chamber 134*a* being of sufficient length and centrally positioned to support both the head, neck and upper shoulders area of a recumbent person. Narrower chamber 136 and its individual chamber components 136*a*, 136*b* and 136*c*, serve to support the center torso and arms of the user, while chamber 138 having central and side component chambers 134*a* and 134*b* and 134*c*, respectively, support the lower torso and upper leg area of the person. Central chamber 140*a* of chamber 140 supports the lower leg area, and finally central chamber 142*a* of chamber 142 supports the feet of the user. Chambers 140*b* and 140*c* and 142*b* and 142*c* serve to primarily control foam material migration.

Figure 14:
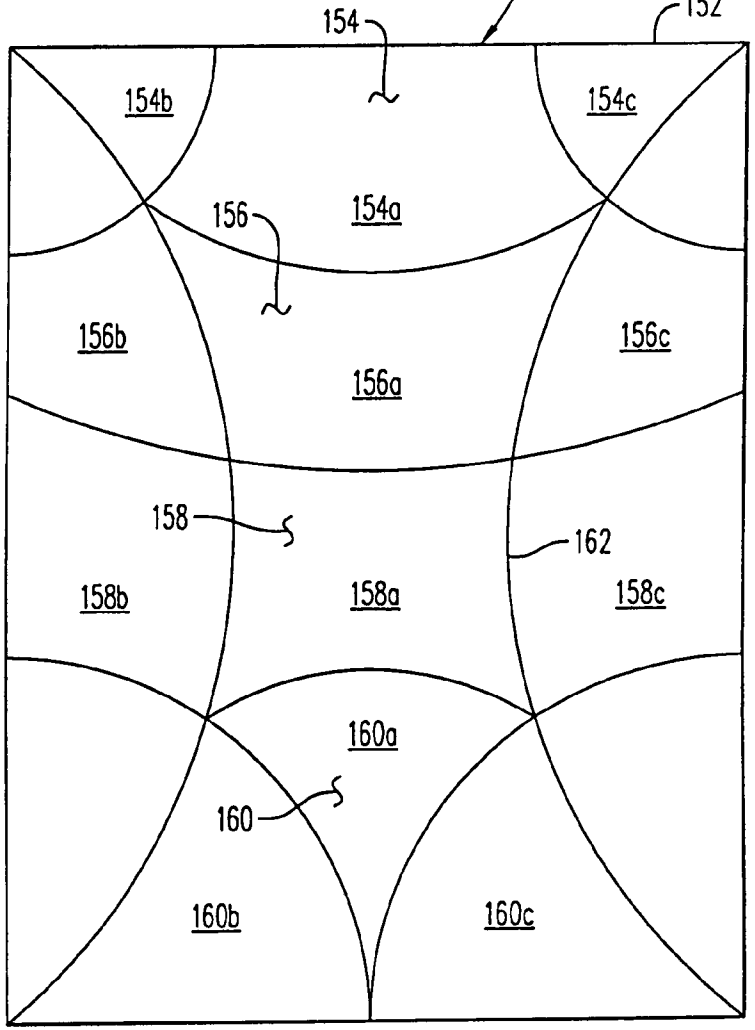
FIGS. 13 to 28 are top plan simplified schematic views of additional alternate embodiments of the invention.

In FIG. 14, another embodiment is shown at 150 including a flexible top sheet of flexible fabric material 152 and intermediate stitching lines shown typically at 162 to define support chambers 154, 156, 158 and 160. The central portions 154*a*, 156*a*, 158*a* and 160*a* are the primary body support chambers while the side chambers 154*b*, 154*c*, 156*b*, 156*c*, 158*b*, 158*c* and 160*b* and 160*c* serve to prevent foam migration and to create the side heightened chambers described in FIG. 6 generally.

Figure 15:
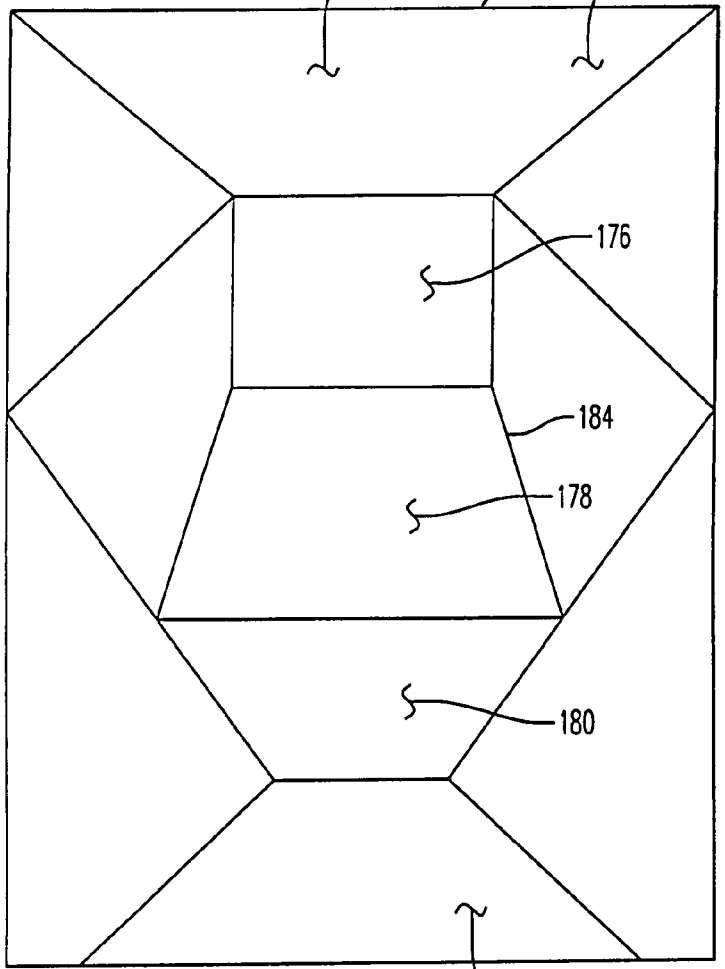

In FIG. 15, another embodiment 170 includes a flexible fabric top sheet 172 generally as previously described sewn by peripheral stitching to a bottom sheet (not shown) along common head, foot and side margins. Separate central body support chambers 174, 176, 178, 180 and 182 are formed by straight intermediate lines of stitching shown typically at 184 which interconnect the top sheet 172 and bottom sheet (not shown) of this embodiment 170. The height of foam sheet material packed into each of these chambers is as previously described with respect to the nominal height achieved thereby.

Figure 16:
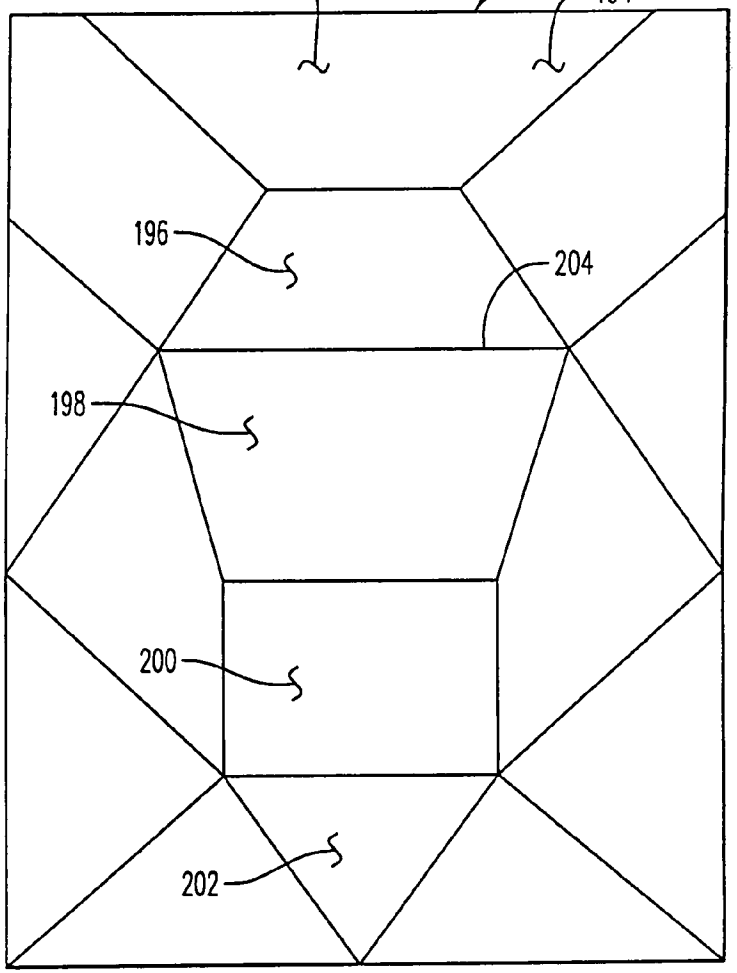

The embodiment 190 in FIG. 16 represents another variation similar to that shown in FIG. 15 wherein intermediate straight stitching lines shown typically at 204 passing through the flexible fabric top sheet 192 and bottom sheet (not shown) create the trapezoidal shaped central chambers 194, 196, 198, 200 and 202 which have the height of the previously described to support the respective body portions of a recumbent person.

Figure 17:
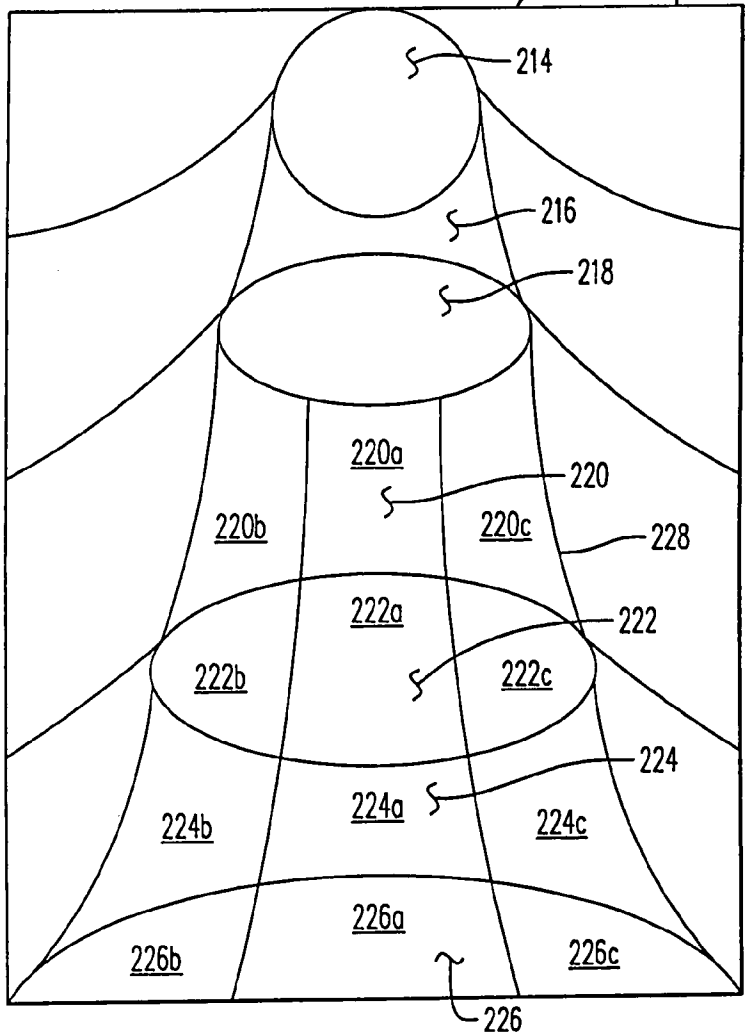

In FIG. 17, an embodiment 210, again having a cover sheet 212 formed of flexible fabric material sewn along the mating peripheral edge to the flexible bottom sheet (not shown), is provided to have increasing widths of the chambers 214, 216, 218, 220, 222, 224 and 226 defined by intermediate stitching lines shown generally at 228 sewn through the top sheet 212 and bottom sheet (not shown). The descending increasing width of these foam-filled chambers 214 to 226 accommodates the more typical movement of spread legs and torso movement as opposed to a central positioning of the head and neck area of a recumbent person during sleep time. The intermediate lines of stitching 228 are arcuate.

Figure 18:
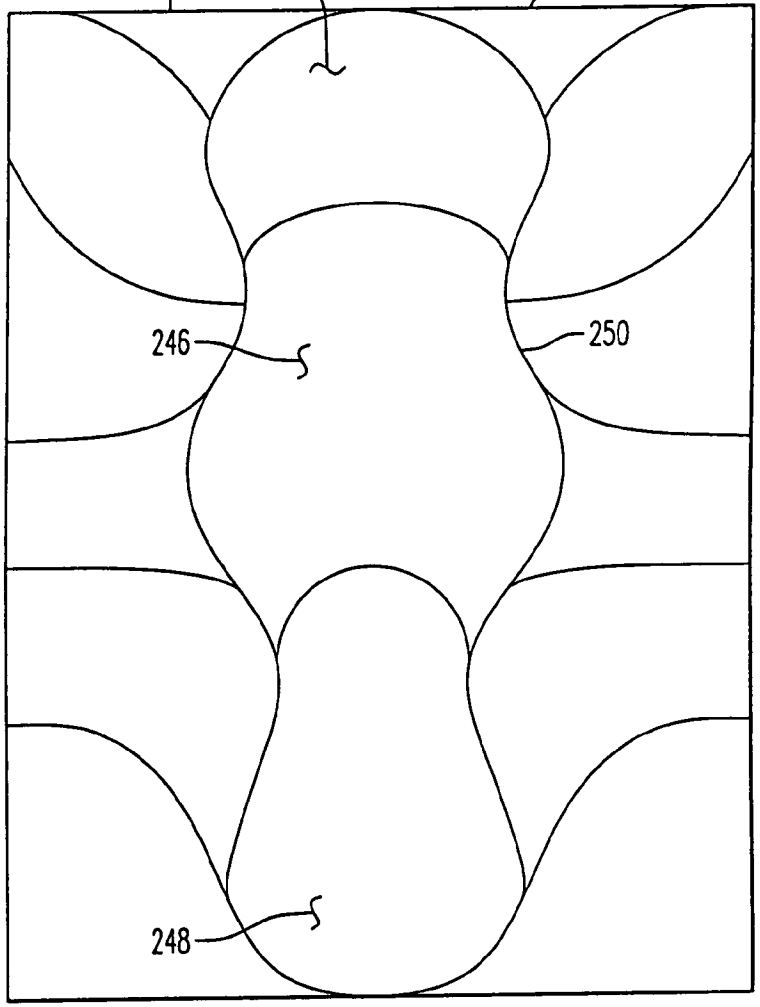

The embodiment 240 in FIG. 18 again includes a flexible top sheet 242 and intermediate arcuately formed lines of stitching shown typically at 250. This embodiment 240 includes elongated chambers: chamber 244 for supporting the head and neck area; chamber 246 for supporting the entire torso area; and chamber 248 for supporting the leg and foot portions of a recumbent person. The central elongated chamber 246 would have a lesser thickness of flexible foam material and having a lower height than the head chamber 244 and the leg/foot chamber 248. The side chambers (not numbered) have a higher fill similar to that generally shown in FIGS. 6 and 8.

Figure 19:
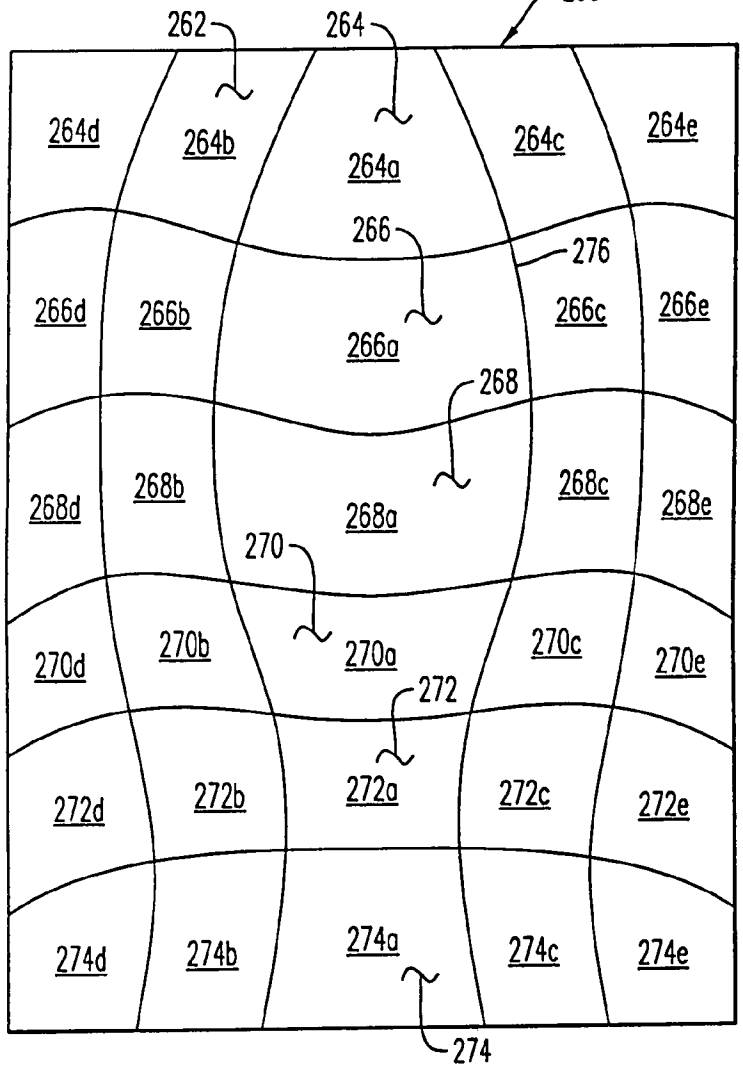

Embodiment 260 shown in FIG. 19 includes intermediate stitching lines 276 through the flexible top sheet 262 and bottom sheet (not shown) which are arcuate and recurved lengthwise of the mattress pad 260 defining central chambers 264*a* of chamber 264, chamber 266*a* of chamber 266, chamber 268*a* of chamber 268, chamber 270*a* of chamber 270, chamber 272*a* of chamber 272 and chamber 274*a* of chamber 274. The enlarged chambers 266*a* and 268*a* provide for additional uniform support for torso movement during sleep time, the side chambers 264*b*, 264*c*, 264*d*, and 264*e* through side chambers 274*b*, 274*c*, 274*d*, and 274*e* provide increasing height of foam material and overall chamber height similar to FIGS. 6 and 8, to keep the recumbent person more centered on the bed during sleep time.

Figure 20:
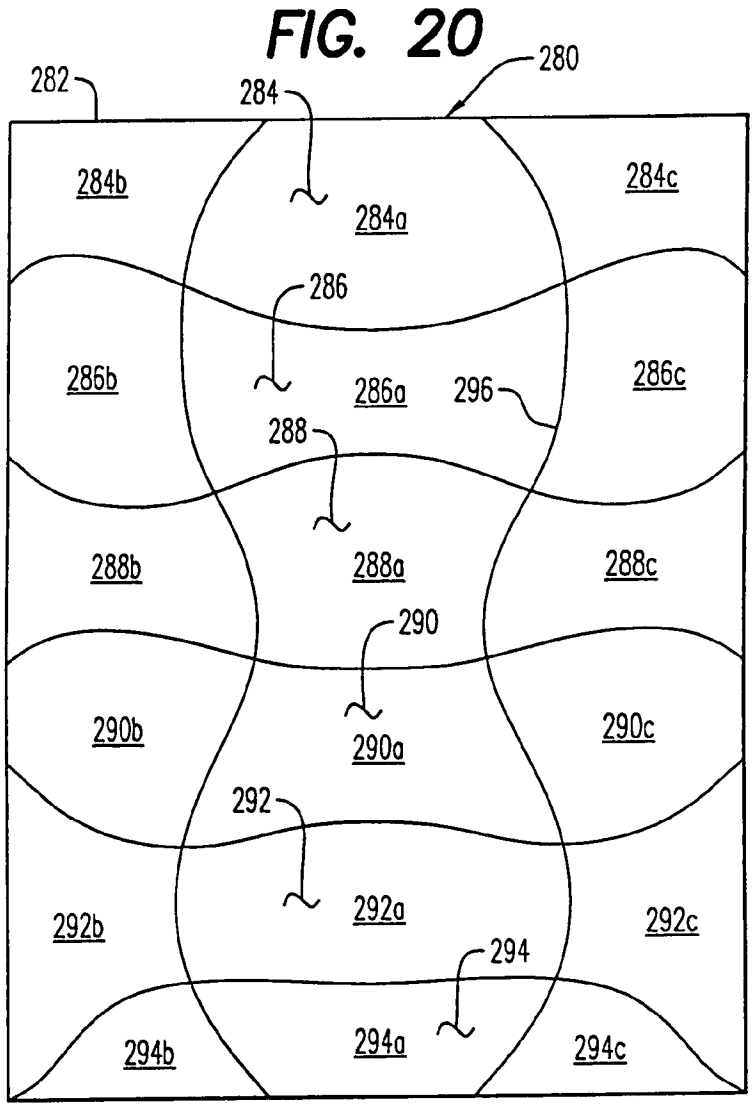

In FIG. 20, the embodiment 280 there shown includes the previously described flexible top sheet 282 which is sewn to the bottom sheet (not shown) through double recurve arcuate stitching lines shown typically at 296. The central chambers 284*a*, 286*a*, 288*a*, 290*a*, 292*a*, and 294*a* are filled to a height generally described in FIGS. 3 to 5 as are all of the embodiments of the invention. The double recurved arcuately configured stitching lines 296 provide a narrower lower torso support chamber 288*a* which is based upon substantially greater movement of arms and legs and the associated chambers 286 and 290. Side chambers 274*b* and 274*c* through 294*b* and 294*c* serve to create heightened edge portions as described in FIGS. 6 and 8 while the foam height of the descending central chambers from 284*a* to 294*a* are as generally described with respect to FIGS. 3 to 5.

Figure 8:
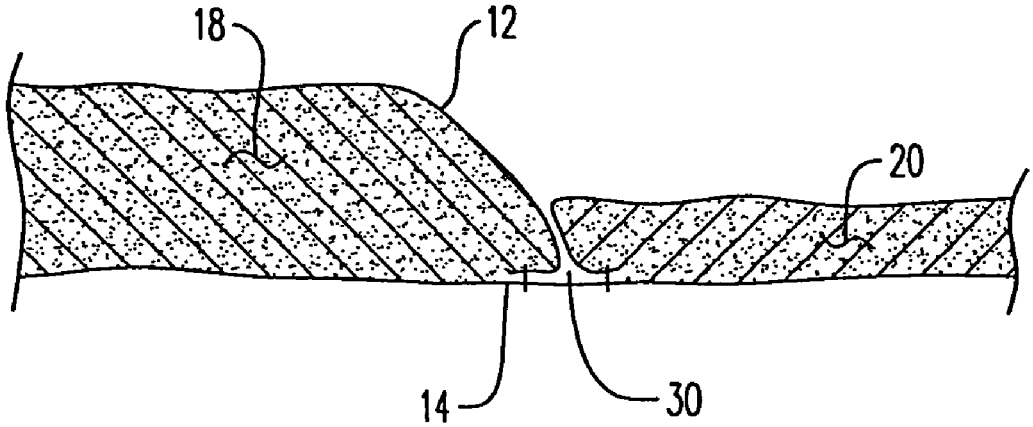
FIG. 8 is an enlarged section view of area 8 of FIG. 2.
Figure 21:
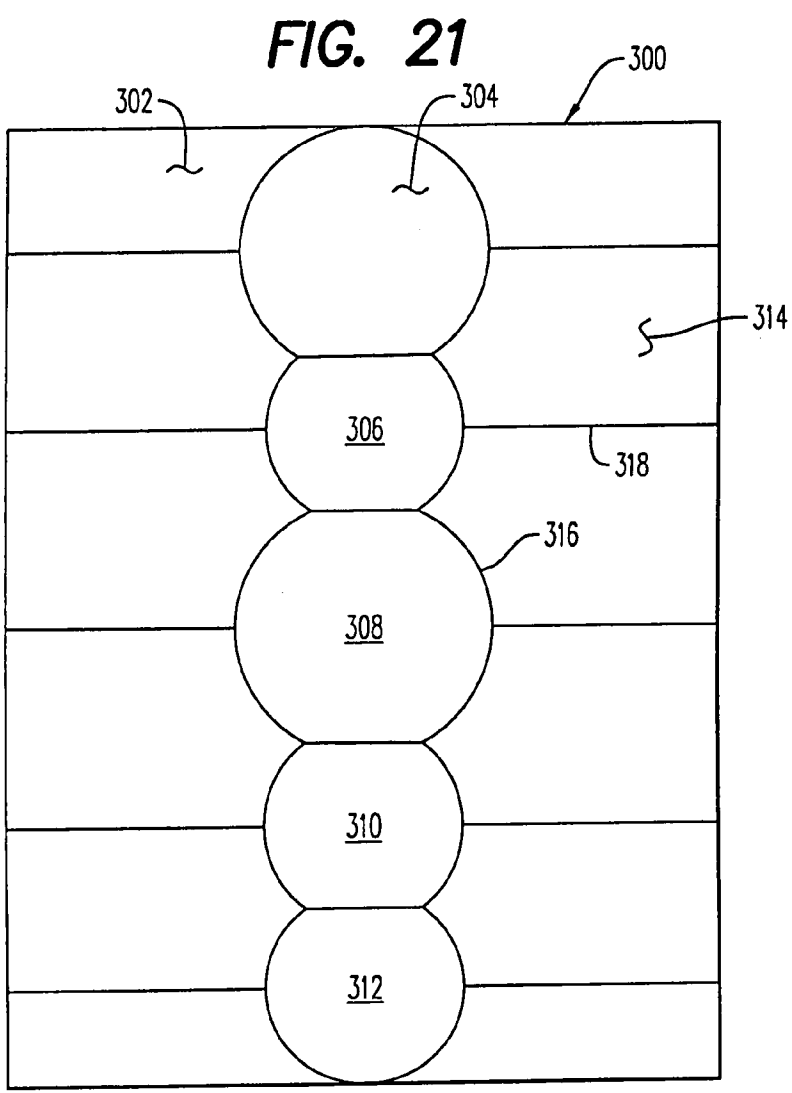
Figure 24:
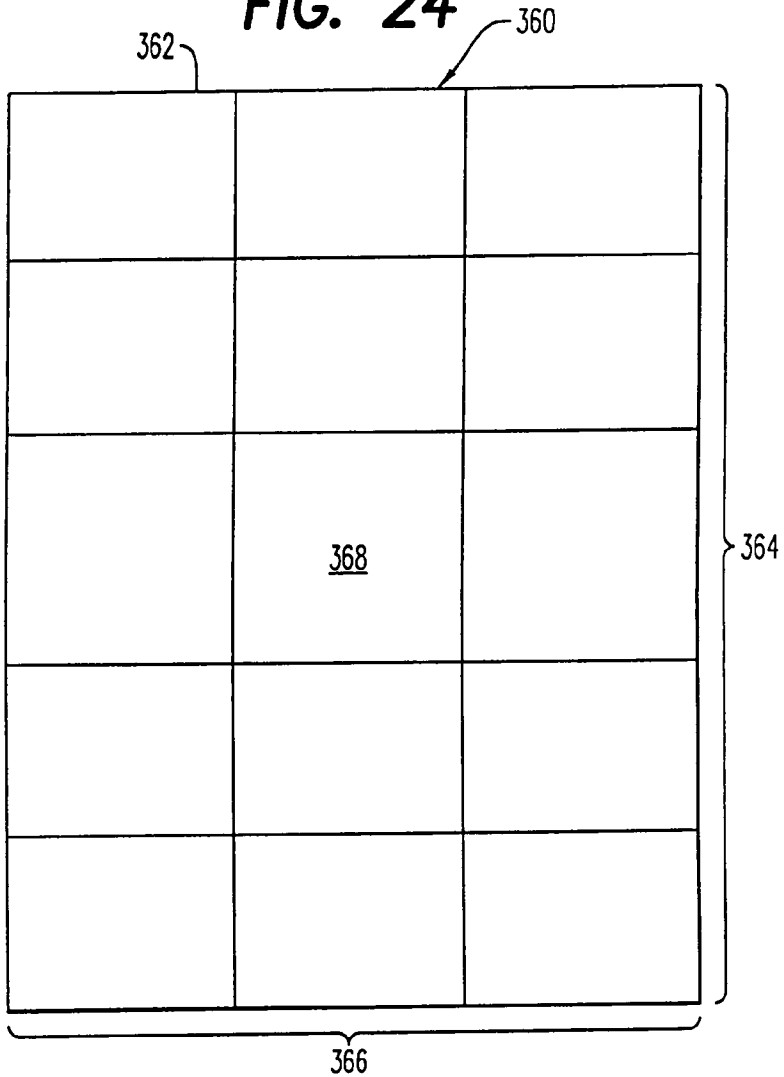
Figure 23:
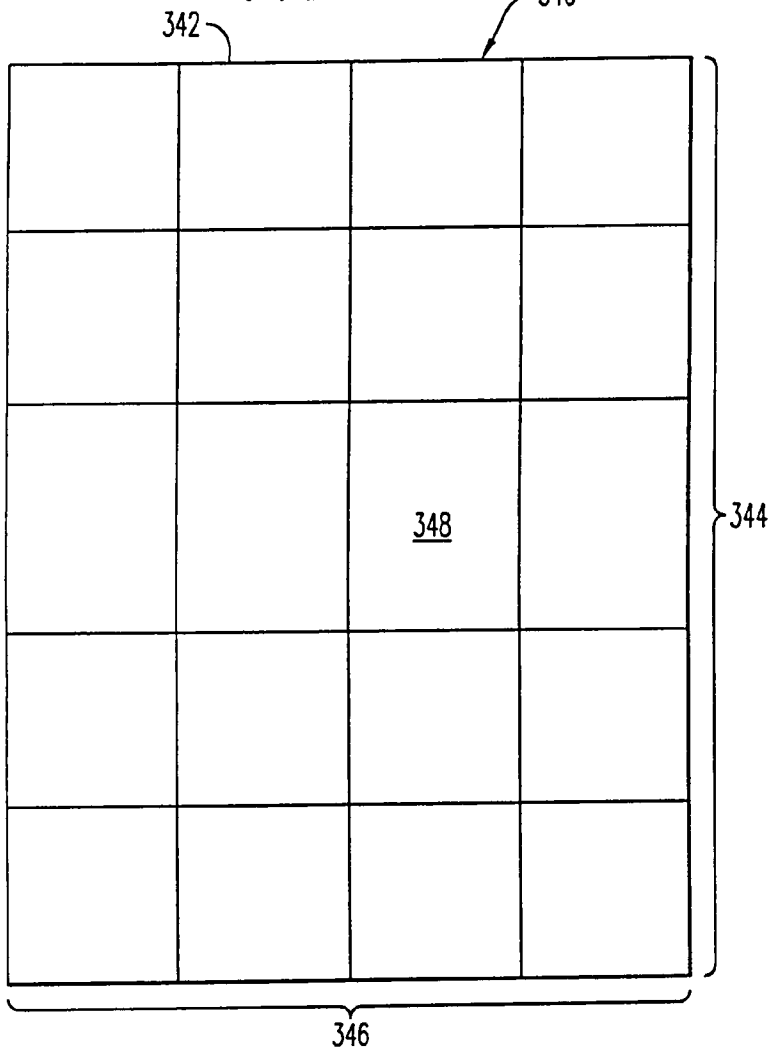
Figure 26:
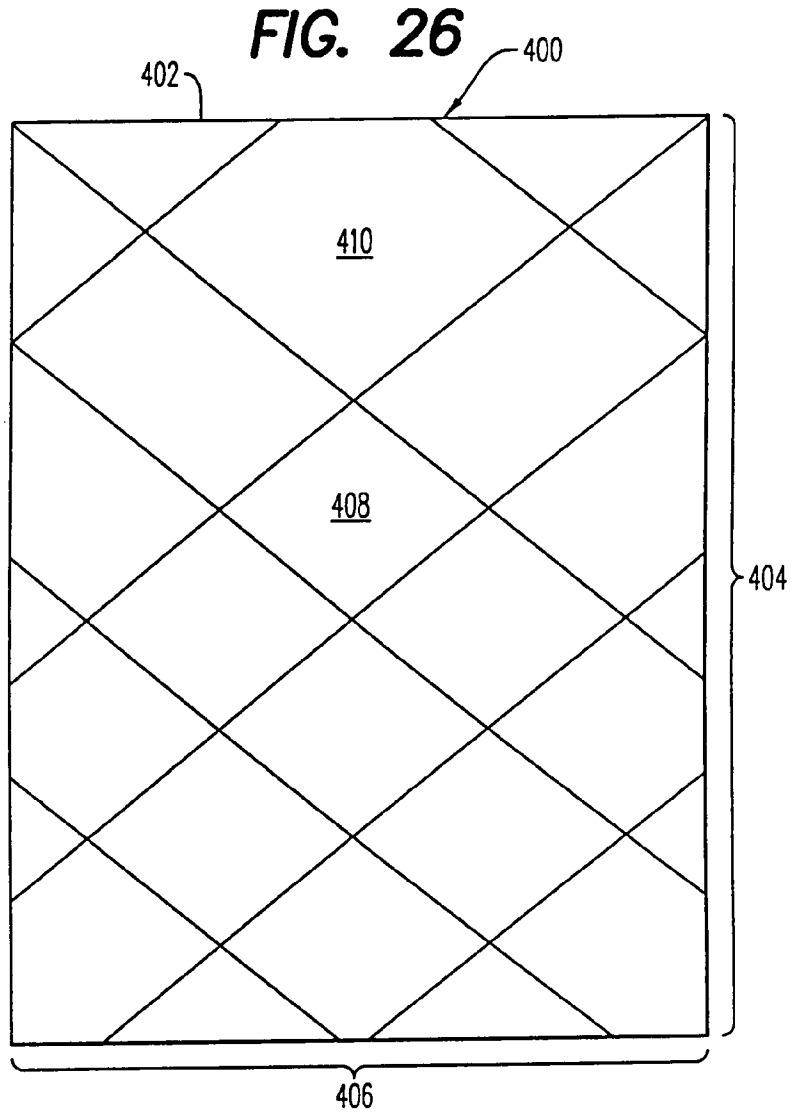
Figure 25:
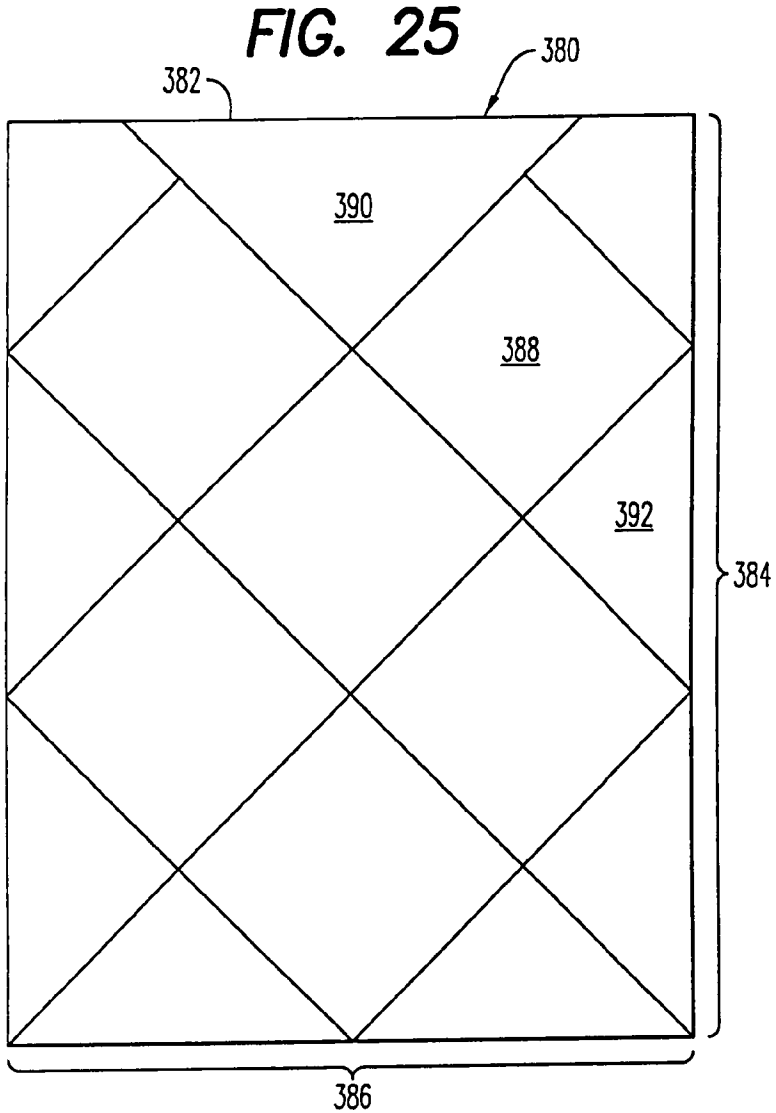

In FIG. 21, another embodiment is there shown generally at numeral 300 having a flexible fabric top sheet 302 connected to the bottom sheet (not shown) by transverse straight lines of stitching 318 and arcuate stitching lines 316 therethrough which create substantially circular central chambers 304, 306, 308, 310 and 312. This circular chamber configuration provides unique opportunities for foam movement and for specialized body support accommodation. Side chambers shown typically at 302 and 314 are generally transverse in nature and are of greater height than the corresponding central chamber as shown in FIGS. 6 and 8.

Figure 22:
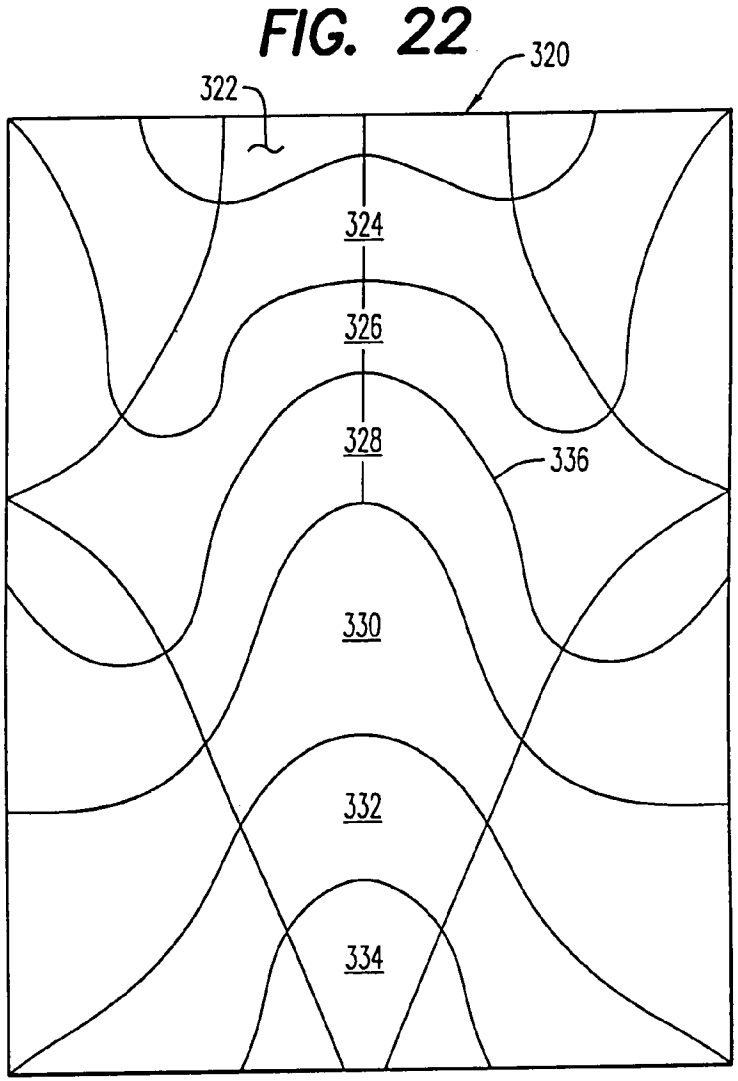

Embodiment 320 in FIG. 22 includes the flexible fabric top sheet 322 sewn along the peripheral margins to the bottom sheet (not shown) and also sewn together along double recurve arcuate lines of stitching shown typically at 336. Central support chambers 322, 324, 326, 328, 330, 332 and 334 in head to foot descending order as previously described are filled with foam sheet and generally of a height of descending and ascending levels as shown in FIGS. 3 to 5.

Briefly in FIGS. 23 to 26, embodiments 340, 360, 380 and 400 include the rectangular chambers 348 and 368 forming central and outer columns 344 and 364 and rows 346 and 366 of these rectangular chambers 348 and 368. Likewise, columns 384 and 404 of diagonal chambers are shown typically at 388 and 408, respectively, extend across rows 386 and 406, respectively, with truncated diamond-shaped chambers 390 and 410, respectively, supporting the head and neck area of the recumbent user.

Figure 27:
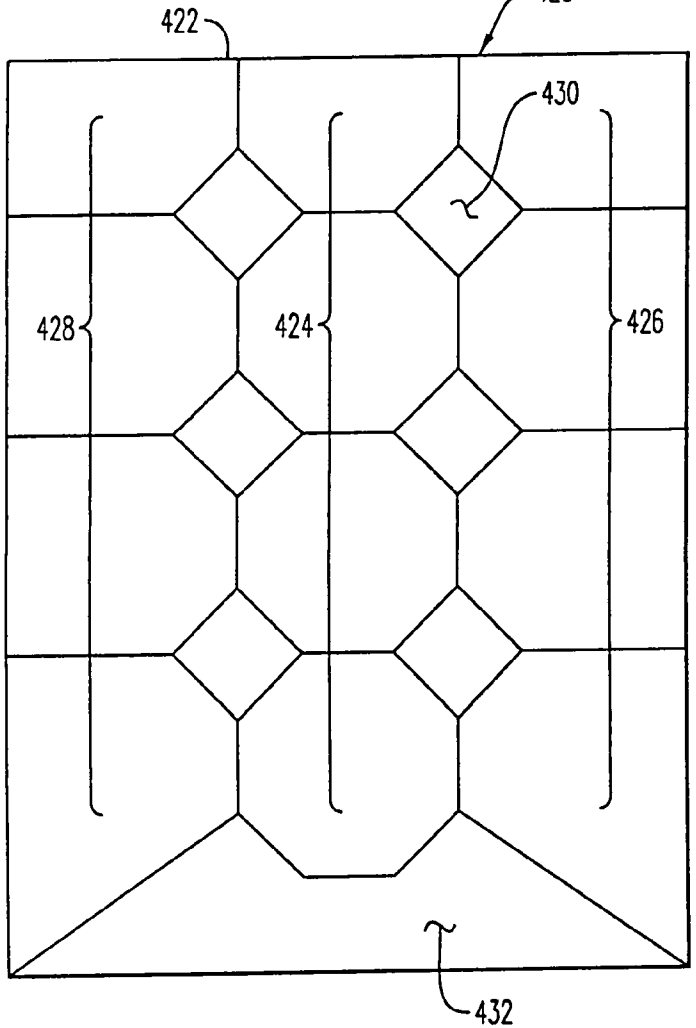

In FIG. 27, this embodiment 420, including flexible fabric top sheet 422 is sewn to the bottom sheet (not shown) by intermediate stitching lines to form a central body supporting column 424 of octagonal central body supporting chambers. Two columns 426 and 428 of side chambers and intermediate diamond shaped chambers 430, each of which is again foam layer filled as previously described, are also provided.

Figure 28:
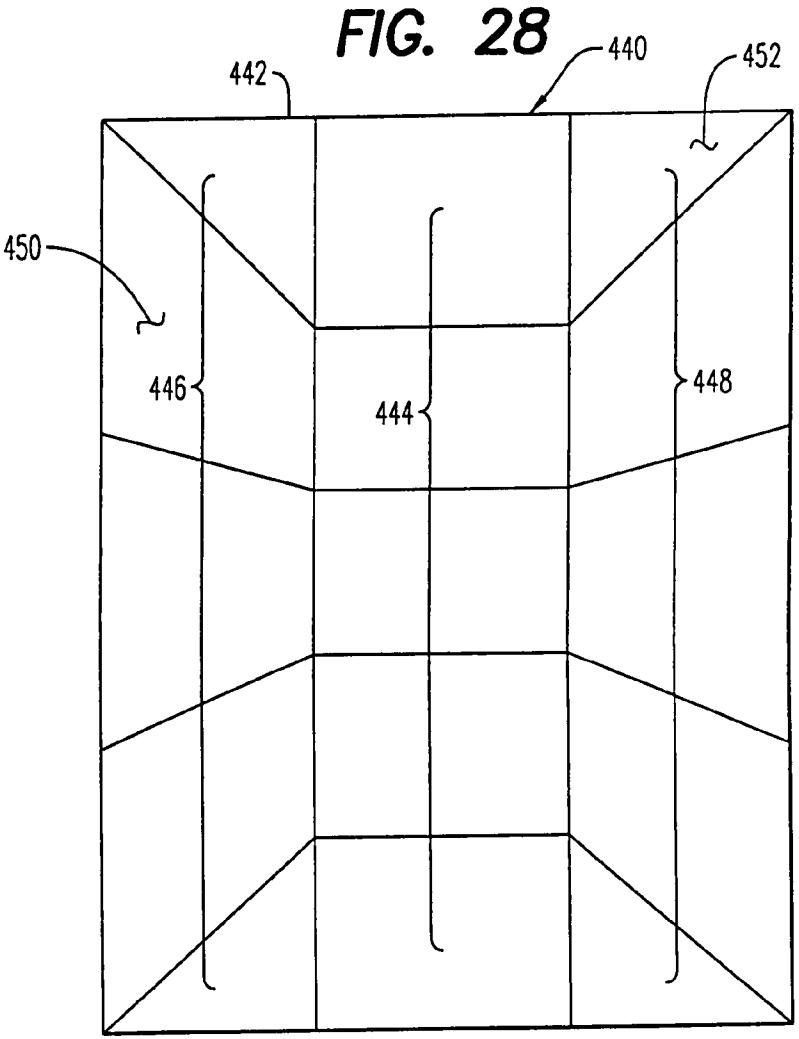

Lastly in FIG. 28, embodiment 440 includes central and side rows 444 and 446/448 of rectangular and trapezoidal shaped chambers 450 and 452 which are defined by intermediate lines of stitching formed through the top sheet 442 and bottom sheet (now shown).

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A mattress pad positionable atop, or foaming a top surface of, a rectangular mattress comprising:

a flexible substantially rectangular bottom sheet having a size and shape substantially similar to that of a top surface of the mattress;

a flexible substantially rectangular fabric top sheet connected to said bottom sheet by peripheral stitching along common perimeter side, head and foot margins;

a plurality of generally side-by-side transversely extending body supporting chambers defined by said peripheral stitching and spaced lines of continuous intermediate stitching which interconnect said top and bottom sheets through thicknesses thereof;

each chamber of said plurality of body supporting chambers is filled with a compressible foam layer;

a first said chamber of said plurality of chambers positioned centrally of a width of said mattress pad and adjacent said head margin to support a head area of a person and having a first nominal thickness of said foam layer between said top and bottom sheets;

a second said chamber of said plurality of chambers positioned centrally of the width of said mattress pad and adjacent said first body supporting chamber to support an upper torso of the person and having a second nominal thickness of said foam layer between said top and bottom sheets;

a third said chamber of said plurality of chambers positioned centrally of the width of said mattress pad and adjacent said second chamber to support a lower torso of the person and having a third nominal thickness of said foam layer between said top and bottom sheets;

a fourth said chamber of said plurality of chambers positioned centrally of the width of said mattress pad and adjacent said third chamber to support a leg area of the person and having a fourth nominal thickness of said foam layer between said top and bottom sheets;

a fifth said chamber of said plurality of chambers positioned centrally of the width of said mattress pad and adjacent said fourth chamber and said foot margin to support feet of the person and having a fifth nominal thickness of said foam layer between said top and bottom sheets;

said first thickness being greater than said second thickness which is greater than said fourth thickness which is greater than either of said third or fifth thicknesses.

2. A mattress pad as set forth in Claim 1, wherein:

said stitching between first and second chambers extends diagonally outwardly and away from said head margin toward each said side margins whereby arms of the person are supported thereby.

3. A mattress pad as set forth in Claim 1, wherein:

said stitching is arcuate in shape.

4. A mattress pad as set forth in Claim 1, further comprising:

a length of said intermediate stitching spaced evenly between said side margins and extending longitudinally to define two side-by-side body support areas for two incumbent persons.

5. A mattress pad as set forth in Claim 1, wherein:

each of said chambers extend only over a central area of said mattress pad, each of said chambers terminating at another length of said intermediate stitching extending generally longitudinally between said side margins and a longitudinal centerline of said mattress pad.

6. A mattress pad as set forth in Claim 1, wherein:

each said chamber is segmented by a plurality of spaced segmenting stitching each extending across said chamber whereby migration of said foam layer within each said chamber is limited by said segmenting stitching.

7. A mattress pad as set forth in Claim 1, wherein:

said foam material is selected from a group including an open or closed cell polyurethane, viscoelastic slabstock foam, a slow recovery foam and a memory foam.

8. A mattress pad positionable atop a rectangular mattress comprising:

a flexible substantially rectangular bottom sheet having a size and shape substantially similar to that of a top surface of the mattress;

a flexible substantially rectangular fabric top sheet connected to said bottom sheet by peripheral stitching along common perimeter side, head and foot margins;

a column of generally side-by-side body supporting chambers each of which is defined by spaced lines of continuous intermediate stitching which interconnect said top and bottom sheets through thicknesses thereof, said column positioned centrally between said perimeter side margin and extending generally between said perimeter head and foot margins;

each said chamber filled with a viscoelastic foam material;

a first of said chambers positioned centrally of a width of said mattress pad and adjacent said head margin to support a head area of a person and having a first nominal thickness of said foam material between said top and bottom sheets;

a second of said chambers positioned centrally of the width of said mattress pad and adjacent said first chamber to support an upper torso of the person and having a second nominal thickness of said foam material between said top and bottom sheets;

a third of said chambers positioned centrally of the width of said mattress pad and adjacent said second chamber to support a lower torso of the person and having a third nominal thickness of said foam material between said top and bottom sheets;

a fourth of said chambers positioned centrally of the width of said mattress pad and adjacent said third chamber and said foot margin to support the legs and feet of the person and having a fourth nominal thickness of said foam material between said top and bottom sheets;

said first thickness being greater than said second thickness which is greater than said fourth thickness which is greater than either of said third thickness.

9. A mattress pad as set forth in Claim 8, wherein:

said stitching between first and second chambers extends diagonally outwardly and away from said head margin toward each said side margins whereby arms of the person are supported thereby.

10. A mattress pad as set forth in Claim 8, wherein:

said stitching is arcuate in shape.

11. A mattress pad as set forth in Claim 8, further comprising:

a length of said intermediate stitching extending longitudinally of said mattress pad and spaced evenly between said side margins to define two side-by-side body support areas for two incumbent persons.

12. A mattress pad as set forth in Claim 8, wherein:

each of said chambers extend only over a central area of said mattress pad, each of said chambers terminating at another length of said intermediate stitching extending generally longitudinally between said side margins and a longitudinal centerline of said mattress pad.

13. A mattress pad as set forth in Claim 8, wherein:

each said chamber is segmented by a plurality of spaced segmenting stitching each extending across said chamber whereby migration of said foam layer within each said chamber is limited by said segmenting stitching.

14. A mattress pad as set forth in Claim 8, wherein:

said foam material is selected from a group including an open or closed cell polyurethane, viscoelastic slabstock foam, a slow recovery foam and a memory foam.

15. A mattress pad positionable atop a rectangular mattress comprising:

a flexible substantially rectangular bottom sheet having a size and shape substantially similar to that of a top surface of the mattress;

a flexible substantially rectangular fabric top sheet connected to said bottom sheet by peripheral stitching along common perimeter side, head and foot margins;

a plurality of body supporting chambers extending in side-by-side fashion lengthwise to said sheets, each chamber of said plurality of body supporting chambers defined by spaced lines of continuous intermediate stitching which interconnect said top and bottom sheets through thicknesses thereof;

each said chamber filled with a resilient, compressible substantially homogeneous open or closed cell urethane foam material which is movable and capable of localized accumulation within said chamber by manual body or hand manipulating pressure against said top sheet;

a first said chamber positioned said head margin to support a head area of a person and having a first nominal thickness of said foam material between said top and bottom sheets;

a second said chamber positioned adjacent said first chamber to support an upper torso of the person and having a second nominal thickness of said foam material between said top and bottom sheets;

a third said chamber positioned adjacent said second chamber to support a lower torso of the person and having a third nominal thickness of said foam material between said top and bottom sheets;

a fourth said chamber positioned adjacent said third chamber to support a leg area of the person and having a fourth nominal thickness of said foam material between said top and bottom sheets;

a fifth said chamber positioned adjacent said fourth chamber and said foot margin to support feet of the person and having a fifth nominal thickness of said foam material between said top and bottom sheets;

said first thickness being greater than said second thickness which is greater than said fourth thickness which is greater than either of said third or fifth thicknesses.

16. A mattress pad as set forth in Claim 15, wherein:

said stitching between first and second chambers extends diagonally outwardly and away from said head margin toward each said side margins whereby arms of the person are supported thereby.

17. A mattress pad as set forth in Claim 15, wherein: said stitching is arcuate in shape.

18. A mattress pad as set forth in Claim 15, wherein:

said foam material is selected from a group including an open or closed cell polyurethane, viscoelastic slab-stock foam, a slow recovery foam and a memory foam.

19. A mattress pad as set forth in Claim 15, further comprising:

a length of said intermediate stitching spaced evenly between said side margins and extending longitudinally to define two side-by-side body support areas for two incumbent persons.

20. A mattress pad as set forth in Claim 15, wherein:

each of said chambers extend only over a central area of said mattress pad, each of said chambers terminating at another length of said intermediate stitching extending generally longitudinally between said side margins and a longitudinal centerline of said mattress pad.

21. A mattress pad as set forth in Claim 15, wherein:

each said chamber is segmented by a plurality of spaced segmenting stitching each extending across said chamber whereby migration of said foam layer within each said chamber is limited by said segmenting stitching.

22. A mattress pad positionable atop, or forming a top surface of, a rectangular mattress comprising:

a flexible substantially rectangular mattress pad mold formed as a single unit of compressible foam material having a size and shape substantially similar to that of a top surface of the mattress, said mattress pad also having a head margin and a foot margin;

a plurality of generally side-by-side transversely extending body supporting chambers defined by molded lines formed into the top surface of said mattress pad;

a first said chamber of said plurality of chambers positioned centrally of a width of said mattress pad and adjacent said head margin to support a head area of a person and having a first nominal thickness;

a second said chamber of said plurality of chambers positioned centrally of the width of said mattress pad and adjacent said first body supporting member to support an upper torso of the person and having a second nominal thickness;

a third said chamber of said plurality of chambers positioned centrally of the width of said mattress pad and adjacent said second chamber to support a lower torso of the person and having a third nominal thickness;

a fourth said chamber of said plurality of chambers positioned centrally of the width of said mattress pad and adjacent said third chamber to support a leg area of the person and having a fourth nominal thickness;

a fifth said chamber of said plurality of chambers positioned centrally of the width of said mattress pad and adjacent said fourth chamber and said foot margin to support feet of the person and having a fifth nominal thickness;

said first nominal thickness being greater than said second nominal thickness which is greater than said fourth nominal thickness which is greater than either of said third or fifth nominal thicknesses.

* * * * *